US007712476B2

(12) United States Patent
Zonsius

(10) Patent No.: US 7,712,476 B2
(45) **Date of Patent: *May 11, 2010**

(54) BIO-DEGRADABLE DISPOSABLE UMBRELLA

(76) Inventor: Pamela Zonsius, 22 Aldridge Rd., Chappaqua, NY (US) 10514

( * ) Notice: Subject to any disclaimer, the term of this patent is extended or adjusted under 35 U.S.C. 154(b) by 0 days.

This patent is subject to a terminal disclaimer.

(21) Appl. No.: 11/605,166

(22) Filed: Nov. 28, 2006

(65) Prior Publication Data

US 2008/0121256 A1 May 29, 2008

(51) Int. Cl.
*A45B 25/18* (2006.01)
*A45B 25/02* (2006.01)

(52) U.S. Cl. ..... 135/33.2; 135/15.1

(58) Field of Classification Search ..... 135/38–39
See application file for complete search history.

(56) References Cited

U.S. PATENT DOCUMENTS

| | | | | |
|---|---|---|---|---|
| 2,136,569 | A * | 11/1938 | Trimpi | 135/41 |
| 2,561,435 | A * | 7/1951 | Woodward | 135/15.1 |
| 5,387,623 | A * | 2/1995 | Ryan et al. | 523/124 |
| 5,854,304 | A * | 12/1998 | Garcia et al. | 523/124 |
| 6,286,528 | B1 * | 9/2001 | Corso et al. | 135/19.5 |
| 6,571,813 | B2 * | 6/2003 | Lin et al. | 135/28 |
| 2005/0288399 | A1 * | 12/2005 | Chen | 524/47 |
| 2006/0219278 | A1 * | 10/2006 | Lohman | 135/16 |

OTHER PUBLICATIONS http://web.archive.org/web/20060418125125/www.bio-tec.biz/products.html.*

* cited by examiner

*Primary Examiner*—David Dunn
*Assistant Examiner*—Danielle Jackson
(74) *Attorney, Agent, or Firm*—Lackenbach Siegel LLP; Myron Greenspan

(57) ABSTRACT

A disposable umbrella includes a staff having an upper end and a lower end suitable for gripping by a user. A fixed collar is mounted on the upper end of the staff. A plurality of main struts are pivotably attached to the fixed collar and extend radially from the fixed collar. The main struts are movable from collapsed positions, wherein the main struts extend generally parallel to the staff, to open positions, wherein the main struts extend outwardly from the staff. A waterproof film is fixed to the main struts, such as by adhesive, and extends generally from the staff to the extended ends of the main struts. A slidable collar has a bore therethrough and is slidably mounted for movement along the staff. A plurality of actuating struts are provided, the actuating struts having an inner ends pivotably attached to the slidable collar and outers end pivotably attached to associated main struts so that movement of the collar along the staff towards the upper end of the staff causes the main struts to move out to their open positions. A latch is provided for selectively holding the slidable collar in a predetermined position on the staff to thereby hold the main struts in the open position, or releasing the slidable collar to allow movement of the slidable collar towards the lower end. The staff, collars, struts, waterproof film and latch are all formed of biodegradable materials. In this way the umbrella may be disposed of without harming the environment.

15 Claims, 4 Drawing Sheets

BIO-DEGRADABLE DISPOSABLE UMBRELLA

BACKGROUND OF THE INVENTION

1. Field of the Invention

The present invention generally relates to umbrellas and, in particular, to a bio-degradable disposable umbrellas.

2. Description of the Prior Art

Umbrellas have long been known and numerous umbrella mechanisms exists for opening and closing or collapsing umbrellas. Umbrellas can typically be broken down into two main categories. The first is a group of relatively permanent or long lasting umbrellas and the second are disposable umbrellas. The traditional umbrellas of the permanent or long lasting type tend to be made with better and stronger materials, possibly more decorative and, for these reasons, are relatively expensive. The disposable umbrellas are generally relative inexpensive so that if such an umbrella is damaged and needs to be discarded the loss is relatively small.

It seems that you never have an umbrella when you need it, and this has led to numerous disposable umbrella designs that are not as complex or expensive as the more traditional umbrellas and are typically expected to fail after one or several uses. Examples of disposable umbrellas are disclosed, for example, in U.S. Pat. Nos. 6,286,528; 6,234,185; 5,964,234; 5,069,237; 4,821,756; 4,819,679; 4,370,993; 4,215,711; 4,542,757; and 3,889,700. All of these umbrellas, while different in design, all tend to be relatively inexpensive this making them "disposable". However, the proliferation of such disposable umbrellas has created a problem for the environment. Thus, many of these umbrellas include materials that are not bio-degradable, such as fiber glass stems or staffs, nylon canopies, various metallic parts, including metallic struts or ribs and spring actuated latches for maintaining the umbrellas in the opened condition. When such "disposable" umbrellas are discarded many of these parts continue to exist and thus present a long range problem for the environment.

While some umbrellas have been used, particularly in the Far East, which are made of bamboo materials and rice paper for a canopy, such umbrellas are primarily used as parasols to protect the user from the suns rays and are not suitable for inclement rainy weather conditions.

SUMMARY OF THE INVENTION

Accordingly, it is an object of the present invention to provide a bio-degradable disposable umbrella that does not have the disadvantages inherent in prior known umbrellas.

It is another object of the invention to provide a bio-degradable disposable umbrella which can be used both for protection against the sun as well as with inclement rainy weather.

It is still another object of the invention to provide an umbrella as in a previous object which is simple in construction and economical to manufacture.

It is yet another object of the invention to provide an umbrella as in the aforementioned objects which is totally made of bio-degradable components so that the umbrella can be discarded without permanently harming the environment.

In order to achieve the above objects, as well as others which will be evident, a bio-degradable disposable umbrella in accordance with the present invention comprises a staff having an upper end and a lower end suitable for gripping by a user. A fixed collar is mounted to said upper end of said staff. A plurality of main struts are pivotably attached to such fixed collar and extend radially from said fixed collar, said plurality of main struts being movable from collapsed positions wherein said main struts extend generally parallel to said staff to open positions wherein said main struts extend outwardly from said staff. A waterproof film in the form of a canopy is fixed to said plurality of main struts and extend generally from said staff to the extended ends of said main struts. A slidable collar having a core therethrough is slidably mounted on said staff. A plurality of actuating struts are provided which have inner ends pivotably attached to said slidable collar and outer ends pivotably that's attached to associated main struts so that moment of said slidable collar along said staff towards said upper end of said staff causes said main struts to move out to said open positions. Latching means is provided for selectively holding said slidable collar in a predetermined position on said staff to thereby hold said main struts in said open positions or releasing said slidable collar to allow movement of said slidable collar towards said lower end, said staff, collars, struts, waterproof film and latching means are all formed of bio-degradable materials. In this manner, the umbrella may be disposed of without harming the environment.

BRIEF DESCRIPTION OF THE DRAWINGS

The above and other objects, features and advantages of the present invention will be better understood from the following specification when read in conjunction with the accompanying drawings.

DESCRIPTION OF PREFERRED EMBODIMENTS

Figure 1:
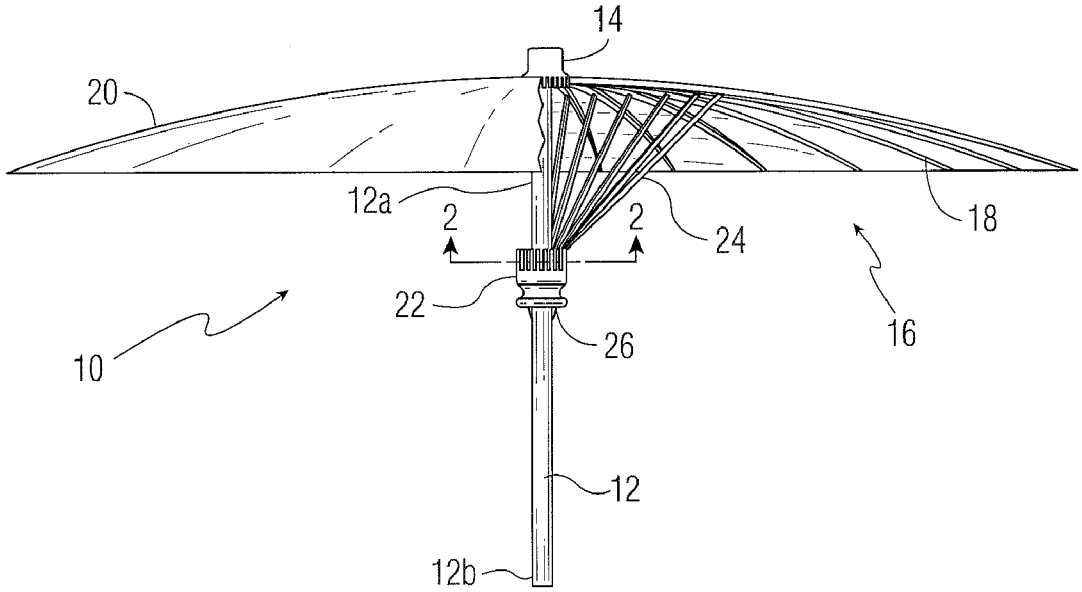
FIG. 1 is a side elevational view of a bio-degradable disposable umbrella in accordance with the present invention, shown partially broken away to show the cooperation of the supporting struts of the collapsible frame.

Referring more specifically to the drawings, in which the identical or similar parts will be designated by the same reference numerals throughout, a bio-degradable disposable umbrella in accordance with the present invention is generally designated by the reference numeral 10.

The umbrella 10 includes a staff, post or rod 12 having an upper end 12*a* and a lower end 12*b* which is typically terminated in a handle or a gripping member to facilitate holding of the umbrella during use.

A fixed collar or hub 14 is mounted at the upper end 12*a* of the staff. A collapsible frame 16 is structurally and functionally similar to a conventional umbrella frames and includes a plurality of main struts or ribs 18 the radially inner ends of which are pivotably attached to the fixed collar or hub 14 and extend radially from the hub. The main struts 18 are movable from collapsed positions (not shown) wherein the main struts extend generally parallel to the staff to open positions, as shown in FIG. 1, wherein the main struts extend outwardly from the staff 12.

A waterproof film or canopy 20 is fixed to the main struts and extend generally from the staff 12 to the extended ends of the main struts as shown. The canopy 20 may be attached to the main struts 18 in any conventional manner.

A slidable collar 22 has a bore 22*a* dimensioned substantially correspond to the outer diameter of the staff or rod 12 to provide a sliding fit there between. The slidable collar is slidably mounted on the staff and move between an upper position shown in FIG. 1 and a position of the slidable hub more approximate to the lower end 12*b* of the staff. The actuating struts or ribs 24 have inner ends pivotably attached to the slidable collar or hub 22 and outer ends pivotably attached to associated main struts 18 so that the movement of the slidable collar 22 along the staff 12 towards the upper end of the staff causes the main struts 18 to move out to the open positions as shown in FIG. 1.

Suitable latching mechanism 26 is provided for selectively holding the slidable collar or hub 22 in a predetermined position on the staff 12 to hold the main struts 18 in the open positions or release the slidable collar or hub to allow movement of the slidable collar towards the lower ends 12*b*.

Figure 2:
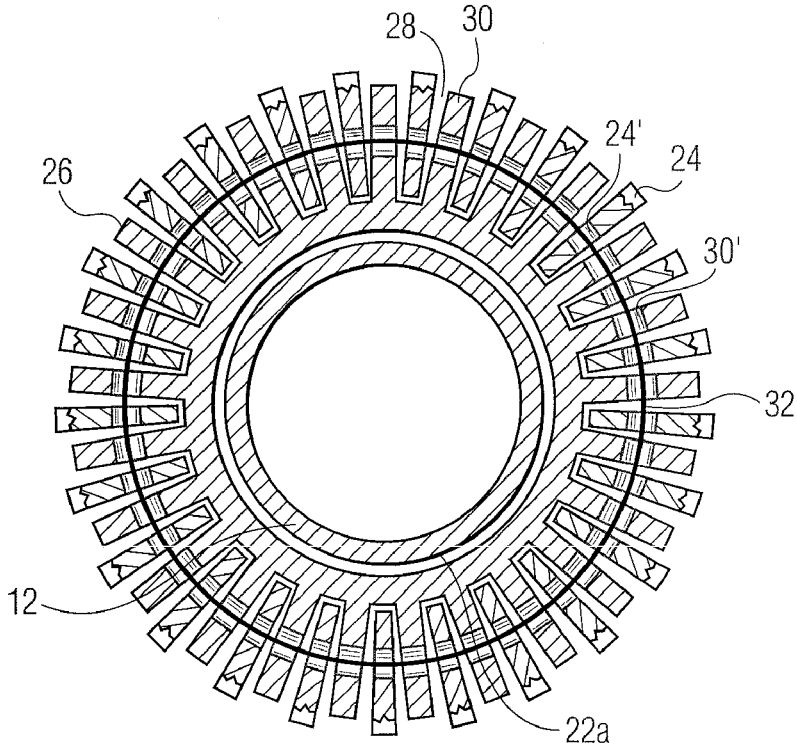
FIG. 2 is an enlarged cross-sectional view of the sliding hub shown in FIG. 1 taken along line 2-2.

The general construction of the collapsible frame 16 and its functions are generally similar to well know umbrella constructions, and the umbrella 10 can be collapsed or locked in the open positions as other conventional umbrellas. However, to avoid using metallic, plastic or other materials which are not biodegradable, the hubs 14, 22 are preferably formed of wood and the struts 18, 24 are likewise made of wood, such as bamboo strips. To provide the desired pivoting or articulation where the struts join each other or where the struts interact with the hubs, the hubs 14, 26 may be constructed as shown in FIG. 2. Thus, the slidable hub 22 is shown having a portion thereof formed with circumferentially spaced slots 28 which, in turn, create spaced walls 30. By aligning holes 24' in the ends of the actuating struts 24 received within the slots 28 with holes 30' formed in the walls 30 a retainer filament 32 may pass through the holes as shown in FIG. 2 to attach the struts to the hub and also serve as pivot points about which the struts may move relative to the hub. A similar construction may be used for the pivotable attachment of the main struts 18 with the fixed hub 14. String, wooden pins or pegs or the like may also be used to pivotably attach or secure the ends of the actuating struts 24 where they are pivotably attached to the main struts 18.

Figure 3:
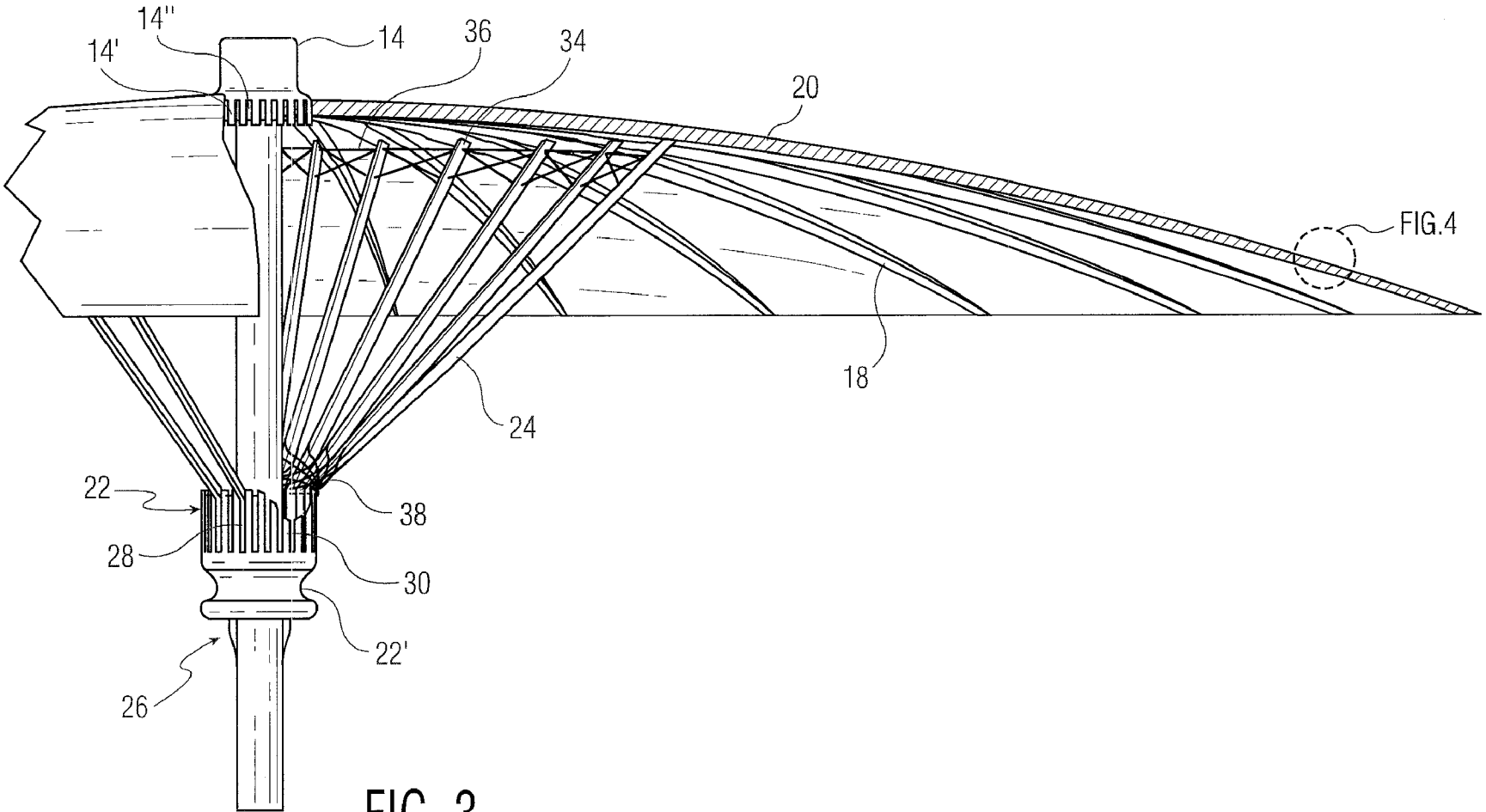
FIG. 3 is similar to FIG. 1, but shown enlarged to indicate additional details of construction.
Figure 4:
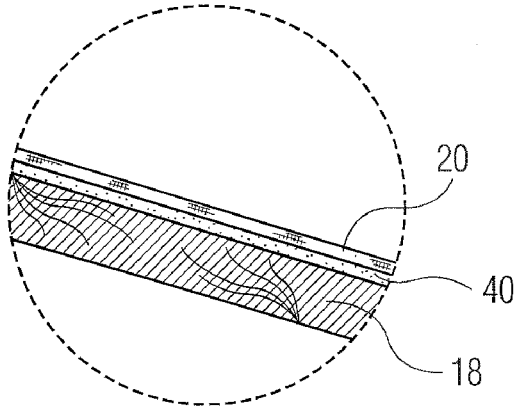
FIG. 4 is an enlarged section of a detail "FIG. 4" shown in FIG. 3.

Referring to FIG. 3, cord or netting 36 may be used to stabilize and maintain the position or relationships between the actuating struts and the main struts and, similarly, cord or netting 38 may be used to secure the relative positions of the actuating struts 24 at the locations approximate to the slidable hub 22.

As suggested, while the main struts 18 may be secured to the waterproof film or canopy 20 in any conventional manner, any suitable biodegradable adhesive 40 may be used, water soluble adhesives generally being suitable for this purpose. Alternately, bio-degradable sections of cord or string may be used as is well known in the art.

Figure 5:
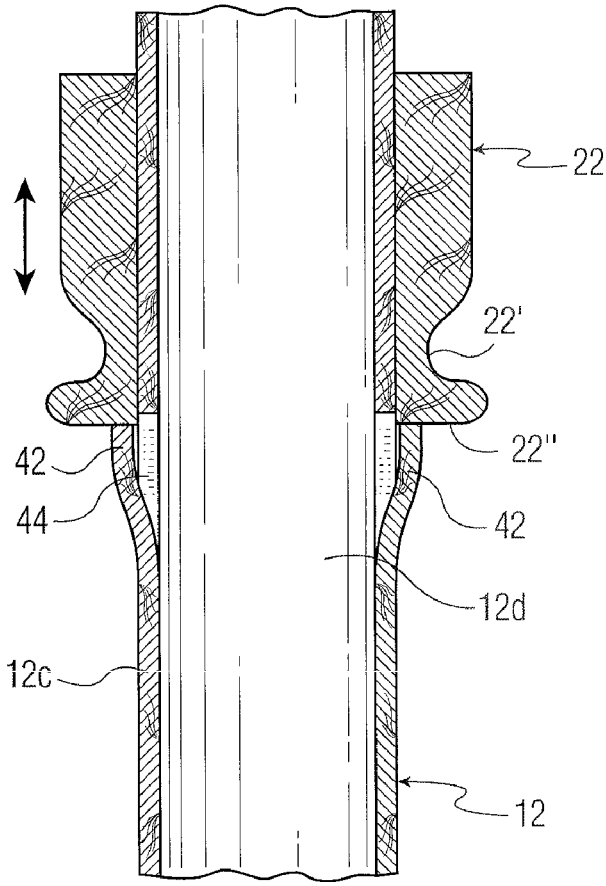
FIG. 5 is a cross-sectional view of the sliding hub and post when the sliding hub is in its locked position to maintain the umbrella in an open or extended position.

Referring to FIG. 5, the staff 12 is shown formed of a hollow bamboo stem having a generally cylindrical wall 12*c* creating a channel 12*d* along the length of the stem. In accordance with the one embodiment of the invention, the latching mechanism 26 is in the form of 2 diametrically opposed portions or tabs 42 that are radially outwardly offset from a distance "d" from the outer surface of the wall 12*c*. The portions or tabs 42 are cut from the sides of the wall to form openings 44 where the tabs originally or situated. By offsetting the tabs as shown, these tabs are movable between a normal radially outwardly extended position as shown in FIG. 5 to engage and retain the slidable collar or hub 22 by engaging the lower surface 22" in a position to retain the struts 18, 24 in the open positions. However, by manually pressing the portions or tabs inwardly there are movable into the openings 44 to clear the surface 22" of the collar 22 and allow these struts to move to the collapsed conditions by moving the movable hub downwardly towards the lower end 12*b*. By making the portions or tabs 42 somewhat resilient they can be bent by application of a radially inward pressure or force but return to there normal positions shown in FIG. 5 when such pressure is released. By flaring or tapering outwardly towards the upper end 12*a* as shown, the slidable hub can be moved to the latching positions by a forcibly sliding the hub beyond the tabs 42, the tabs being urged into the openings 44 by the hub 22 itself and snap back to the positions shown in FIG. 5 when the hub 22 is moved beyond the tabs 42.

Figure 6:
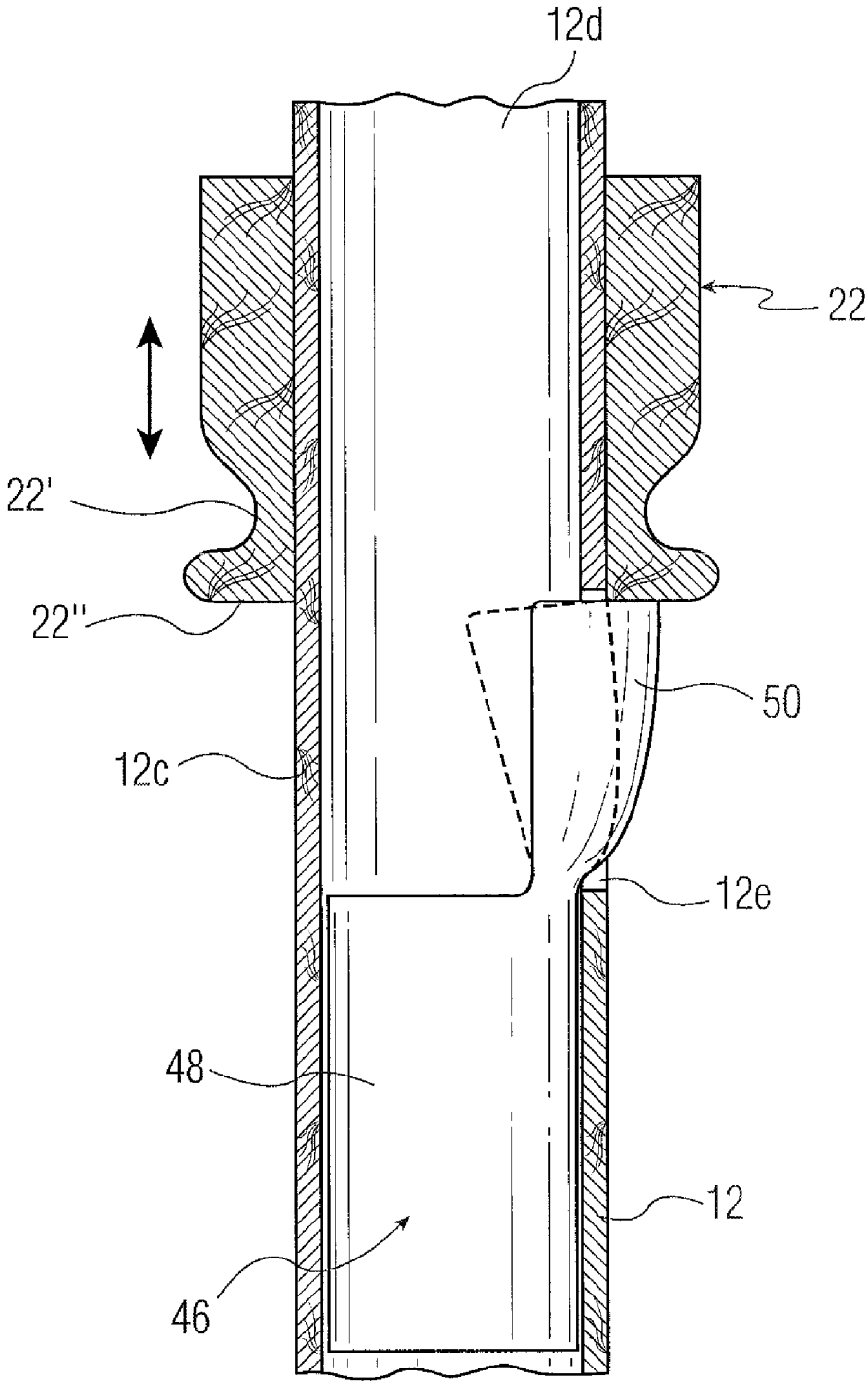
FIG. 6 is similar to FIG. 5, but showing a different embodiment of a latching mechanism for maintaining the hub in its locked or latched position.

In accordance with another embodiment of the latch 26, wherein the staff 12 is formed of a hollow bamboo stem having the generally cylindrical wall 12*c*, the latch includes an insert 46 that has a plug 48 dimensioned to be securely held within the channel 12*d* in a deflectable tab 48 that is movable between an extended or locking position shown as solid outline in FIG. 6, and a releasing position shown in phantom outline. The deflectable tab 50 is normally bias or urged to extend outwardly through the opening 12*e* in the wall of the staff to engage the lower surface 22' of the slidable hub. When the umbrella is to be collapsed the deflectable tab 50 can be pressed inwardly to be received within the channel 12*d* to clear the hub and allow the hub to move towards the lower end 12*b*.

It will be evident that the latching mechanisms shown in FIGS. 5 and 6 may be formed totally of wood such as from bamboo or other wood that can sustain a limited degree of flexing or bending without breaking.

An important feature of the invention, as noted, is that every single component of the umbrella is bio-degradable, so that the staff 12 is made of wood such as a bamboo stem. The struts are likewise made of wood and may be formed of bamboo strips. The collars or hubs are likewise made of wood and the retaining filament 32 as well as the cords or nettings 36, 38 are also made of bio-degradable material, such as cotton.

The waterproof film or canopy needs to satisfy to parameters. It must be waterproof to functionally serve the purpose for which the umbrella is used, namely to prevent water from passing therethrough, but must also be bio-degradable. Any suitable materials may be used for this purpose. Thus, for example, bio-degradable fabrics, such as cotton textiles may be used if treated with water repelling substances. In accordance with the presently preferred embodiment, the canopy is formed of a bio-degradable plastics. Such plastics may be derived from plant sources, such as hemp oil, soil bean oil and corn starch rather than traditional plastics which are derived from petroleum. The bio-degradable materials, therefore, do not rely on fossil fuel imports and produce less greenhouse submissions bio-plastics, for example, are truly bio-degradable as opposed to what is traditionally referred as "bio-degradable plastic" which is derived from petroleum and mixed with heavy metals which cause some plastics, such as polyethylene, to break down. Also, for example, certain additives are available for rendering some plastics bio-degradable. Such an additive is available, for example, from Bio-Tech Environmental of Cedar Crest, N.M. which produces "Bio-batch"™ bio-degradable additive which when mixed with PE, PP, PS, PET or PVC renders the plastic resin completely bio-degradable in 1-5 years. The additive does not change the physical properties of the plastic itself and has an indefinite shelf life until placed in an active microbial environment (like a landfill where most plastics end up). Because traditional plastics are so durable that they will not rot or decay as do natural products such as those made of wood, traditional umbrellas have been serious problems for the environment since literally millions of umbrellas are used daily and have a limited life because of their generally delicate constructions.

While the invention has been shown and described in connection with a preferred form of an embodiment it will be understood that modifications may be made without the departure from the scope or spirit of the invention.

The invention claimed is:

1. A disposable umbrella comprising:

a staff having an upper end and a lower end suitable for gripping by a user;

a fixed collar mounted to said upper end of said staff;

a plurality of main struts pivably attached to said fixed collar and extending radially from said fixed collar, said plurality of main struts being movable from collapsed positions wherein said main struts extend generally parallel to said staff to open positions wherein said main struts extend outwardly from said staff;

a waterproof film fixed to said plurality of main struts and extending generally from said staff to the extended ends of said main struts, said film being a waterproof film formed of a PVC petroleum-based plastic and an additive that substantially retains the physical properties of the PVC petroleum-based plastic but renders the PVC petroleum-based plastic film biodegradable when placed in an active landfill microbial environment;

a slidable collar having a bore therethrough and being slidably mounted on said staff;

a plurality of actuating struts, said actuating struts having an inner end pivotably attached to said slidable collar and an outer end pivotably attached to associated main struts so that movement of said collar along said staff towards said upper end of said staff causes said main struts to move out to said open positions; and latching means for selectively holding said slidable collar in a predetermined position on said staff to thereby hold main struts in said open positions, or releasing said slidable collar to allow movement of said slidable collar towards said lower end, said staff, collars, struts, waterproof film and latching means are all formed of biodegradable materials, whereby the umbrella may be disposed of in a landfill without harming the environment.

2. A disposable umbrella as in claim 1, wherein said staff is made of wood.

3. A disposable umbrella as in claim 2, wherein said wood is a bamboo stem.

4. A disposable umbrella as in claim 1, wherein said main struts are made of wood.

5. A disposable umbrella as in claim 1, wherein said actuating struts are made of wood.

6. A disposable umbrella as in claim 1, wherein said collars are made of wood.

7. A disposable umbrella as in claim 1, wherein said struts are pivotably attached to said collars by means of bio-degradable string.

8. A disposable umbrella as in claim 7, wherein said string is made of cotton.

9. A disposable umbrella as in claim 1, wherein said latching means if formed of wood.

10. A disposable umbrella as in claim 1, wherein said staff is formed of a hollow bamboo stem having a generally cylindrical wall, and said latching means comprises at least one portion of said wall radially outwardly offset and movable between a normal radially outwardly extended position to engage and retain said slidable collar in a position to retain said struts in said open positions and being movable upon application of radially inward pressure on said at least one portion to clear said slidable collar and allow said struts to move to said collapsed conditions.

11. A disposable umbrella as in claim 1, wherein said staff is formed of a hollow bamboo stem having a generally cylindrical wall, and said latching means comprises a bio-degradable member including a first portion positionable within a hollow channel of said stem and a second portion movable relative between a first position extending radially outwardly through an opening beyond said wall to engage and retain said slidable collar in a position to retain said struts in said open positions and being movable upon application of radially inward pressure on said second portion to clear said slidable collar and allow said struts to move to said collapsed conditions.

12. A disposable umbrella as in claim 11, wherein said bio-degradable member is formed of wood.

13. A disposable umbrella as in claim 1, wherein said waterproof film is secured to said main struts by means of bio-degradable adhesive.

14. A disposable umbrella as in claim 1, wherein said waterproof film is secured to said main struts by means of a heat seal.

15. A disposable umbrella comprising:

a staff having an upper end and a lower end suitable for gripping by a user;

a fixed collar mounted to said upper end of said staff;

a plurality of main struts pivably attached to said fixed collar and extending radially from said fixed collar, said plurality of main struts being movable from collapsed positions wherein said main struts extend generally parallel to said staff to open positions wherein said main struts extend outwardly from said staff;

a waterproof film fixed to said plurality of main struts and extending generally from said staff to the extended ends of said main struts, said film being a waterproof film formed of a PVC petroleum-based plastic and an additive that substantially retains the physical properties of the PVC petroleum-based plastic but renders the PVC petroleum-based plastic film biodegradable when placed in an active landfill microbial environment;

a slidable collar having a bore therethrough and being slidably mounted on said staff;

a plurality of actuating struts, said actuating struts having an inner end pivotably attached to said slidable collar and an outer end pivotably attached to associated main struts so that movement of said collar along said staff towards said upper end of said staff causes said main struts to move out to said open positions; and latching means for selectively holding said slidable collar in a predetermined position on said staff to thereby hold main struts in said open positions, or releasing said slidable collar to allow movement of said slidable collar towards said lower end, said staff, collars, struts, waterproof film and latching means are all formed of biodegradable materials, whereby the umbrella may be disposed of in a landfill without harming the environment.

* * * * *